US011091227B2

(12) United States Patent
Lebo et al.

(10) Patent No.: US 11,091,227 B2
(45) Date of Patent: Aug. 17, 2021

(54) LOAD-BEARING FRAME STRUCTURE FOR MARITIME VEHICLES

(71) Applicant: Dive Technologies Inc., Quincy, MA (US)

(72) Inventors: William T. Lebo, Quincy, MA (US); Jerrold N. Sgobbo, Hingham, MA (US); Samuel J. Russo, Pittsfield, MA (US); Timothy G. Raymond, Abington, MA (US)

(73) Assignee: DIVE TECHNOLOGIES INC., Quincy, MA (US)

( * ) Notice: Subject to any disclaimer, the term of this patent is extended or adjusted under 35 U.S.C. 154(b) by 0 days.

(21) Appl. No.: 16/675,446

(22) Filed: Nov. 6, 2019

(65) Prior Publication Data

US 2020/0156740 A1 May 21, 2020

Related U.S. Application Data

(60) Provisional application No. 62/769,747, filed on Nov. 20, 2018.

(51) Int. Cl.

| | |
|---|---|
| ***B63C 11/00*** | (2006.01) |
| ***B63B 3/34*** | (2006.01) |
| ***B63B 3/13*** | (2006.01) |

(52) U.S. Cl.

CPC ..... *B63B 3/34* (2013.01); *B63B 3/13* (2013.01); *B63B 2241/04* (2013.01)

(58) Field of Classification Search

CPC .... B63B 3/00; B63B 3/13; B63B 3/14; B63B 3/145; B63B 3/16; B63B 3/26;

(Continued)

(56) References Cited

U.S. PATENT DOCUMENTS 1,980,998 A 11/1934 Knight
6,386,131 B1 5/2002 Barsoum (Continued)

FOREIGN PATENT DOCUMENTS

CN 108016569 5/2018

OTHER PUBLICATIONS

"Emerging Disruptive Technologies Assessment Symposium | Trusted Autonomous Systems" Australian Government Department of Defense Science and Technology (https://www.dst.defence.gov.au/event/emerging-disruptive-technologies-assessment-symposium-trusted-autonomous-systems) (Date accessed: Nov. 20, 2019) (2015).

(Continued)

*Primary Examiner* — Daniel V Venne
(74) *Attorney, Agent, or Firm* — Polsinelli PC

(57) ABSTRACT

A load-bearing frame structure for a maritime vehicle includes two support plates, a deck plate structure, a front bulkhead structure, and a back bulkhead structure. Each of the support plates has a front edge, a back edge, a top edge, and a bottom edge. The support plates can be angled relative to each other and connected to each other at the top edges thereof forming an inverted V-shape. The support plates can alternately be parallel to each other in a vertical orientation. The support plates each have one or more cut-out sections. The deck plate structure connects the two support plates proximate the bottom edges of the support plates. The front bulkhead structure connects the front edges of the support plates, and the back bulkhead structure connects the back edges of the support plates.

33 Claims, 16 Drawing Sheets

(58) Field of Classification Search
CPC ..... B63B 2003/265; B63B 3/32; B63B 3/34; B63B 3/56; B63B 3/58; B63B 2241/04; B63B 3/1142; B63B 3/36; B63B 3/48
USPC ..... 114/312, 313, 314, 341, 77 R, 77 A, 78, 114/85
See application file for complete search history.

(56) References Cited

U.S. PATENT DOCUMENTS

| | | | | |
|---|---|---|---|---|
| 9,381,986 | B2 * | 7/2016 | Brizard | B63B 21/26 |
| 9,457,879 | B2 * | 10/2016 | Brizard | G01V 1/166 |
| 10,011,152 | B1 | 7/2018 | Kremkau et al. | |
| 2006/0225810 | A1 | 10/2006 | Baylot | |
| 2014/0053768 | A1 | 2/2014 | Brizard | |

OTHER PUBLICATIONS

"Hydroid Introduces the New Generation REMUS 100 AUV," Hydroid, (https://www.hydroid.com/news/hydroid-introduces-new-generation-remus-100-auv) (Date accessed: Nov. 20, 2019) (2016).
"Proteus Dual-Mode Underwater Vehicle," Naval Technology, (https://www.naval-technology.com/projects/proteus-dual-mode-underwater-vehicle/) (Date accessed: Nov. 20, 2019).
"U.S. military plans to be completed in 2014 large-scale unmanned submarine," Autonomous Undersea Vehicle Applications Center, (https://auvac.org/newsitems/view/1402) (Date accessed: Nov. 20, 2019) (2012).
"Unmanned Systems," Collins Aerospace, 37(5):1-46 (https://issuu.com/auvsi3/docs/july-augus-web-2/34) (Date accessed: Nov. 20, 2019) (2019).
Ashton, "Unmanned Systems The New Horizen," Presented to: 10th International MIW Technology Symposium, (https://docplayer.net/42366133-Unmanned-systems-the-new-horizon.html) (Date accessed: Nov. 20, 2019) (2012).
John, @benjohn65, (https://twitter.com/benjohn65/status/1155007732249849856/photo/1) (Date accessed: Nov. 20, 2019) (2019).
Sutton, "Russia launches first Project-885M Yasen-M SSGN," (http://www.hisutton.com/April_2017.html) (Date accessed: Nov. 20, 2019) (2017).
Woods Hole Oceanographic, (https://www.whoi.edu/multimedia/northward-ho/) (Date accessed: Nov. 20, 2019) (2017).
International Search Report Issued in PCT/US2019/059985 dated Mar. 16, 2020, 4 pages.
Written Opinion of the International Searching Authority issued in PCT/US2019/059985 dated Mar. 19, 2020, 5 pages.

* cited by examiner

LOAD-BEARING FRAME STRUCTURE FOR MARITIME VEHICLES

CROSS REFERENCE TO RELATED APPLICATION

This application claims priority from U.S. Provisional Patent Application No. 62/769,747 filed on Nov. 20, 2018 entitled LOAD-BEARING FRAME STRUCTURE FOR AUTONOMOUS UNDERWATER VEHICLES, which is hereby incorporated by reference.

BACKGROUND

The present application relates generally to maritime vehicles and, more particularly, to a load-bearing frame structure for such vehicles.

BRIEF SUMMARY OF THE DISCLOSURE

A load-bearing frame structure for a maritime vehicle in accordance with one or more embodiments includes two support plates, a deck plate structure, a front bulkhead structure, and a back bulkhead structure. Each of the support plates has a front edge, a back edge, a top edge, and a bottom edge. The support plates are angled relative to each other and connected to each other at the top edges thereof forming an inverted V-shape. The support plates each have one or more cut-out sections. The deck plate structure connects the two support plates proximate the bottom edges of the support plates. The front bulkhead structure connects the front edges of the support plates, and the back bulkhead structure connects the back edges of the support plates.

A load-bearing frame structure for a maritime vehicle in accordance with one or more further embodiments includes two support plates, a deck plate structure, a front bulkhead structure, and a back bulkhead structure. Each of the support plates has a front edge, a back edge, a top edge, and a bottom edge. The support plates are parallel to each other and in a vertical orientation. The support plates each have one or more cut-out sections. The deck plate structure is in a horizontal orientation and connects the two support plates. The front bulkhead structure connects the front edges of the support plates, and the back bulkhead structure connects the back edges of the support plates.

BRIEF DESCRIPTION OF THE DRAWINGS

Like or identical reference numbers are used to identify common or similar elements.

DETAILED DESCRIPTION

Figure 1:
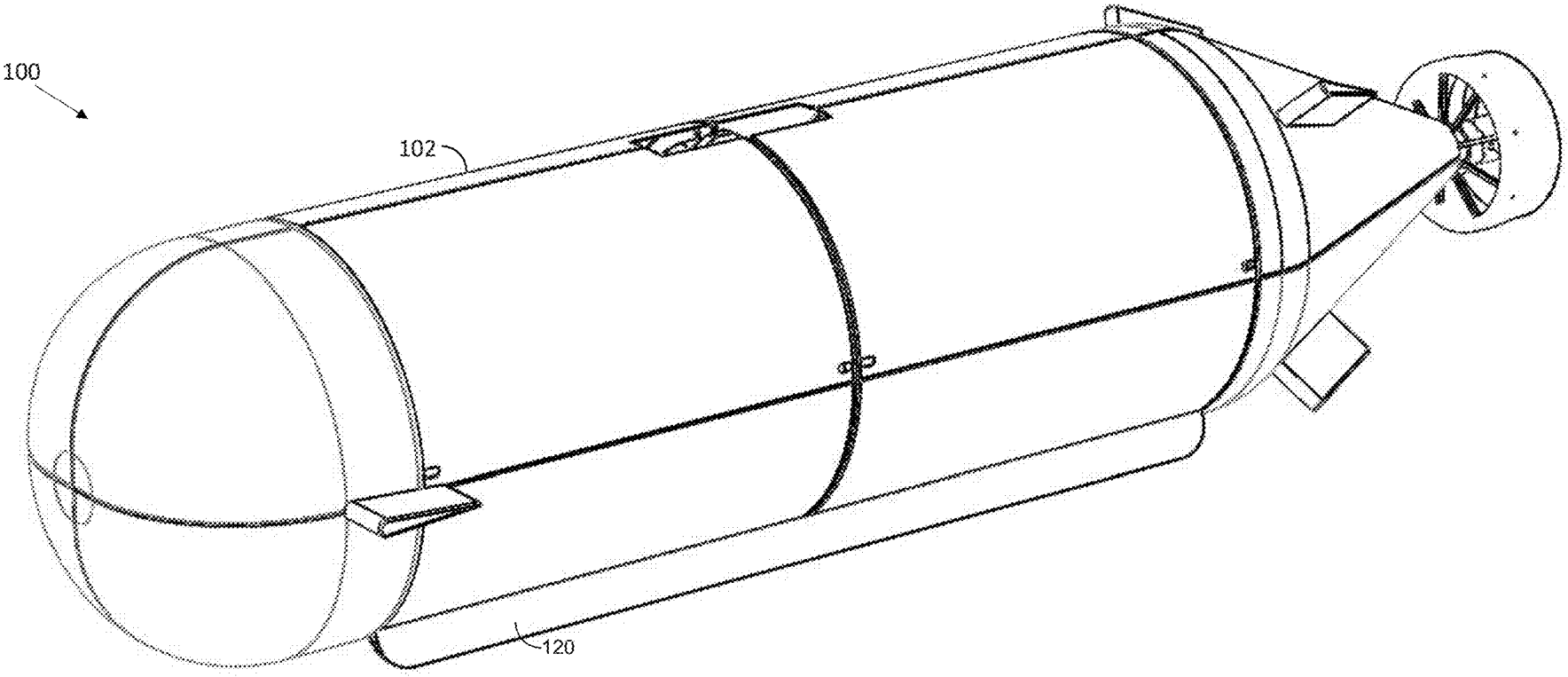
FIG. 1 is a perspective view of an exemplary maritime vehicle in accordance with one or more embodiments.
Figure 2:
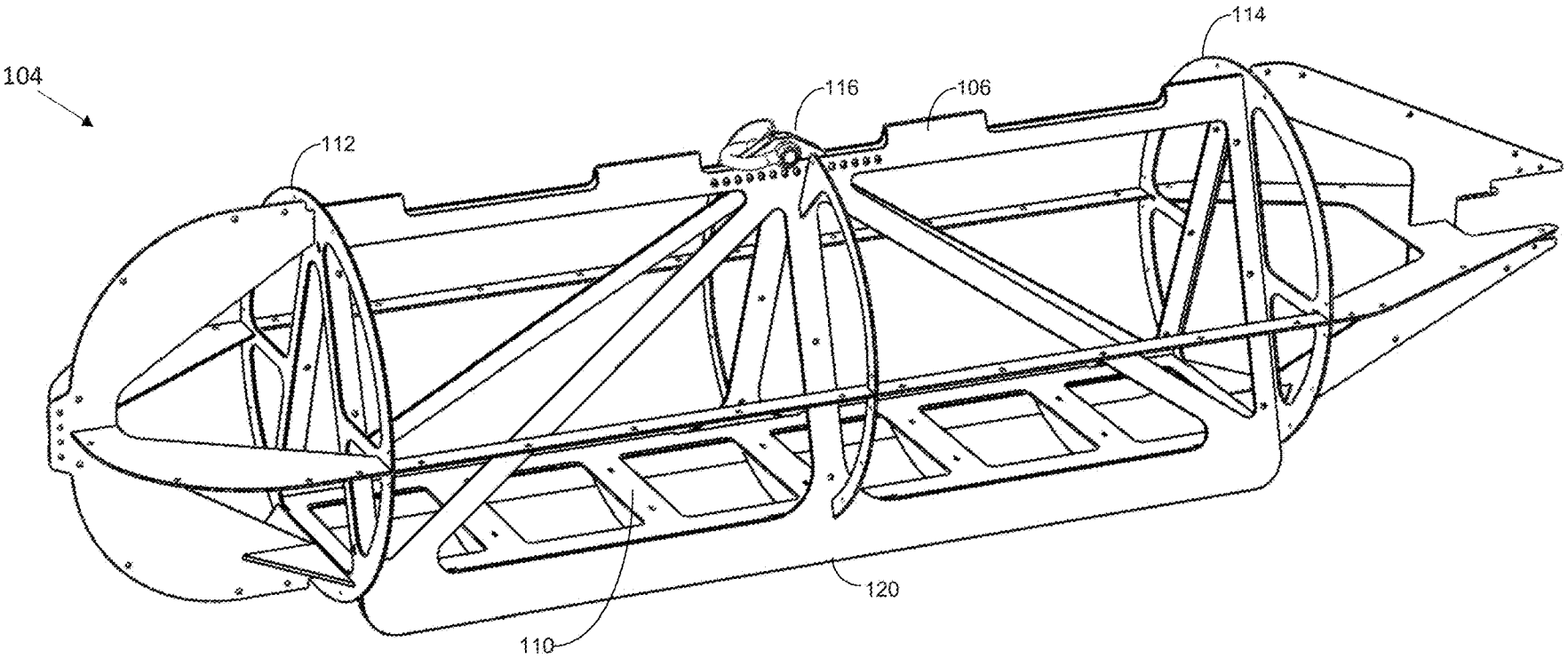
FIG. 2 is a perspective view of an exemplary load-bearing frame structure for the maritime vehicle of FIG. 1 in accordance with one or more embodiments.
Figure 3:
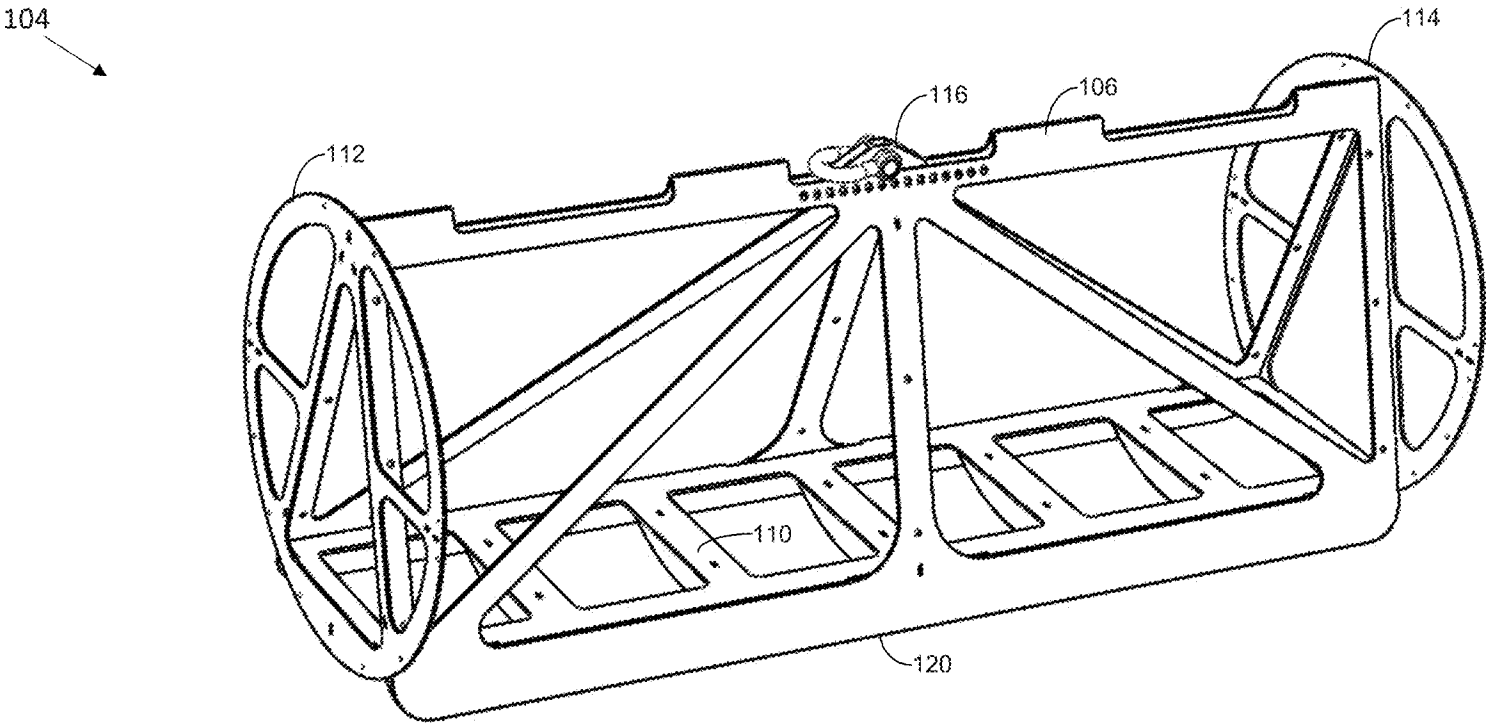
FIG. 3 is a perspective view of the center section of the loadbearing frame structure of FIG. 2.
Figure 4:
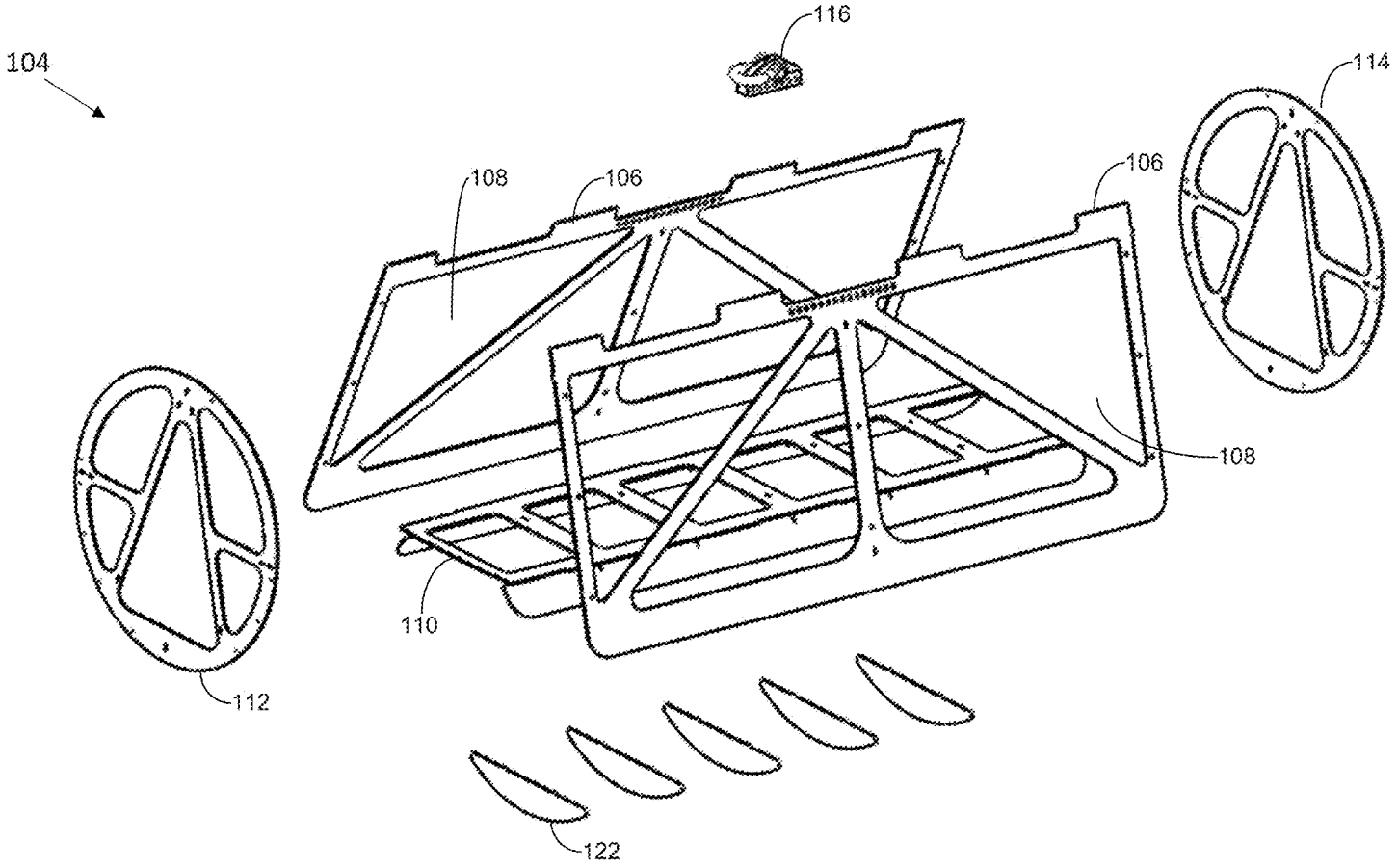
FIG. 4 is an exploded view of the center section of the loadbearing frame structure of FIG. 2.
Figure 5:
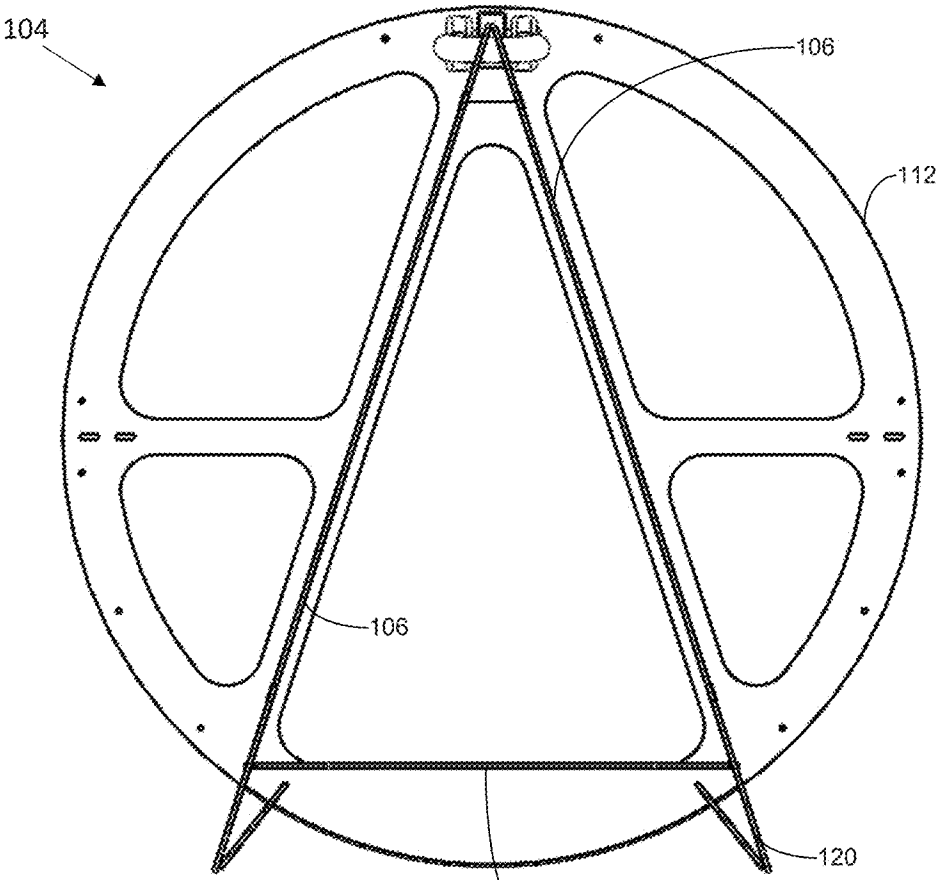
FIG. 5 is a front view of the center section of the loadbearing frame structure of FIG. 2.

FIG. 1 is a perspective view of an exemplary maritime vehicle 100 in accordance with one or more embodiments. The vehicle 100 includes a load-bearing frame structure (shown in FIGS. 2-8) covered by an external fairing 102 for streamlining the vehicle. The fairing is a non-structural, non-sealing external surface intended to contain and protect vehicle components while reducing hydrodynamic drag. The exemplary embodiment illustrated in the drawings has a 48 inch diameter. However, the size of the vehicle is scalable as needed.

FIGS. 2-8 illustrate an exemplary load-bearing frame structure 104 in accordance with one or more embodiments. The load-bearing frame structure 104 includes two angled support plates 106 whose top edges are connected to each other forming an inverted V-shape. In one exemplary embodiment, the two support plates 106 form an angle of about 36° to each other. Other angles are also possible, e.g., 10° to 60°.

The support plates 106 include sections 108 that have been cut-out to reduce weight, leaving the remaining portions of the plates to provide structural support. Various processes may be used to remove the cutout sections 108 from the support plates 106. Such processes can include, e.g., a waterjet cutting process or a laser cutting process. In one or more alternate embodiments, the two support plates 106 can be 3-D printed.

A deck plate 110 connects the two support plates 106 near the bottom edges of the support plates 106.

The frame structure 104 also includes a front bulkhead structure 112 connecting the front edges of the two support plates 106. It further includes a back bulkhead structure 114 connecting the back edges of the two support plates 106.

The frame structure 104 also includes a center lifting shackle 116 connected to the top edges of the two support plates 106. The center lifting shackle 116 can be used in lifting the entire maritime vehicle from a single point. In one or more alternate embodiments, particularly for longer vehicles, two or more lifting shackles that are spaced apart along the length of the vehicle can be used for lifting the vehicle.

The bottom edges of the support plates 106 extend beyond the fairing or hull. They form vehicle support skids 120, which are configured to support the vehicle 100 on a surface without additional support equipment.

The frame structure 104 also includes a set of structural bilge bulkheads 122 connected to the underside of the deck plate 110. Optionally, the deck plate 110 and the bilge bulkheads 122 form a removable subassembly that can be separated from the rest of the frame structure 104 to improve access to equipment and payload held in the vehicle.

In accordance with one or more embodiments, the two support plates 106, the deck plate 110, the front bulkhead structure 112, and the back bulkhead structure 114 each comprise aluminum or aluminum alloys, stainless steel, titanium, or plastic. In one particular embodiment, the components are each constructed from 5083 aluminum alloy sheets.

In one particular embodiment, the components are each constructed from ¼ inch thick sheets. The thickness of the components can be varied depending on the size of the frame structure 104 and the desired loading capacity.

The two support plates 106, the deck plate 110, the front bulkhead structure 112, and the back bulkhead structure 114 are preferably welded together. The components can also be connected using other means, including using nuts and bolts and other fasteners.

The outer edges of the front bulkhead 112 and the back bulkhead 114 can be circular and are configured to support the vehicle fairing. Other shapes are also possible. For example, in one or more alternate embodiments, the front and back bulkheads can be square in shape with rounded corners 141 as shown in the embodiment of FIGS. 9 and 10.

Figure 6:
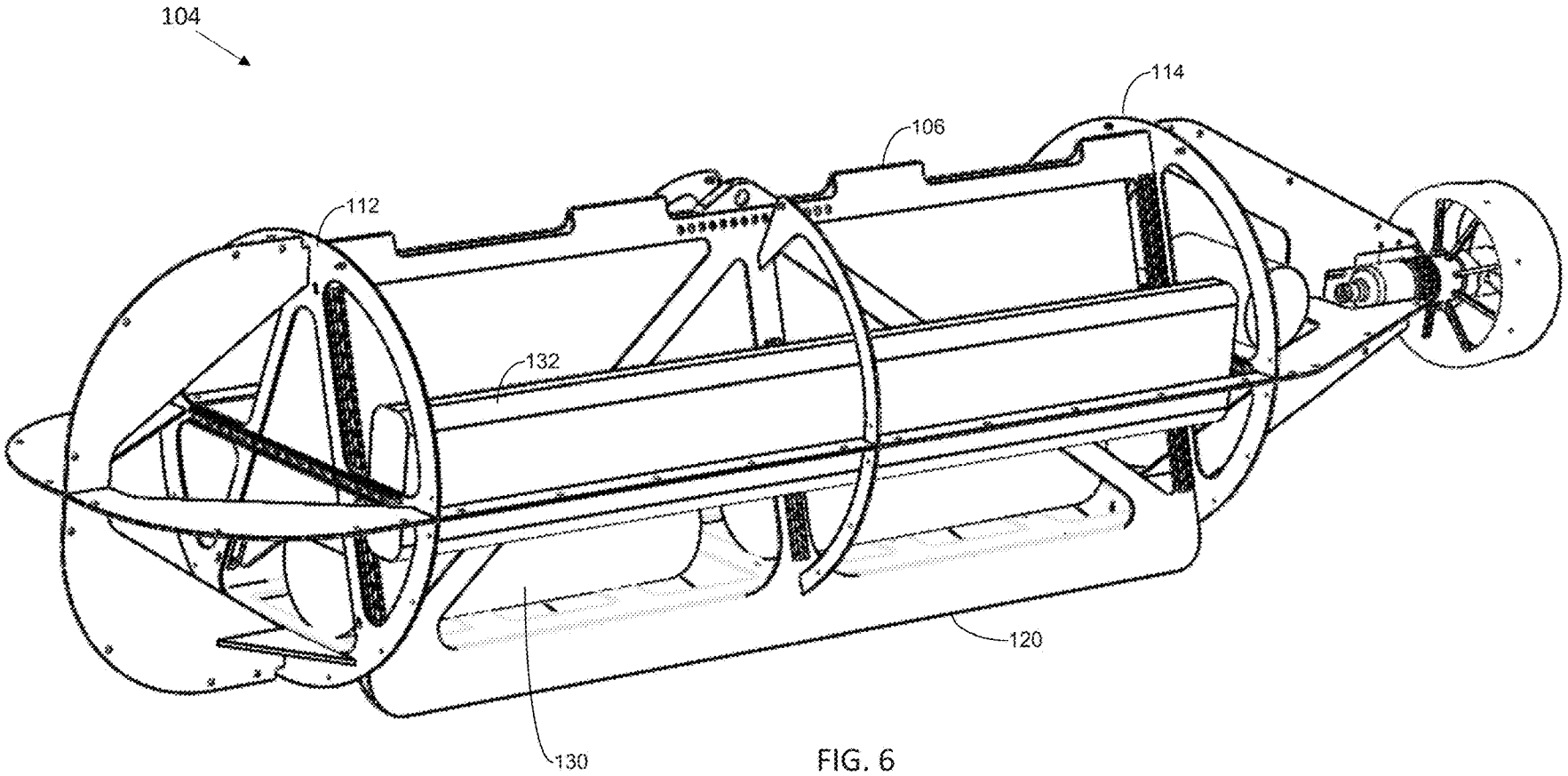
FIG. 6 is a perspective view of the loadbearing frame structure of FIG. 2 with a sample payload installed therein.
Figure 8:
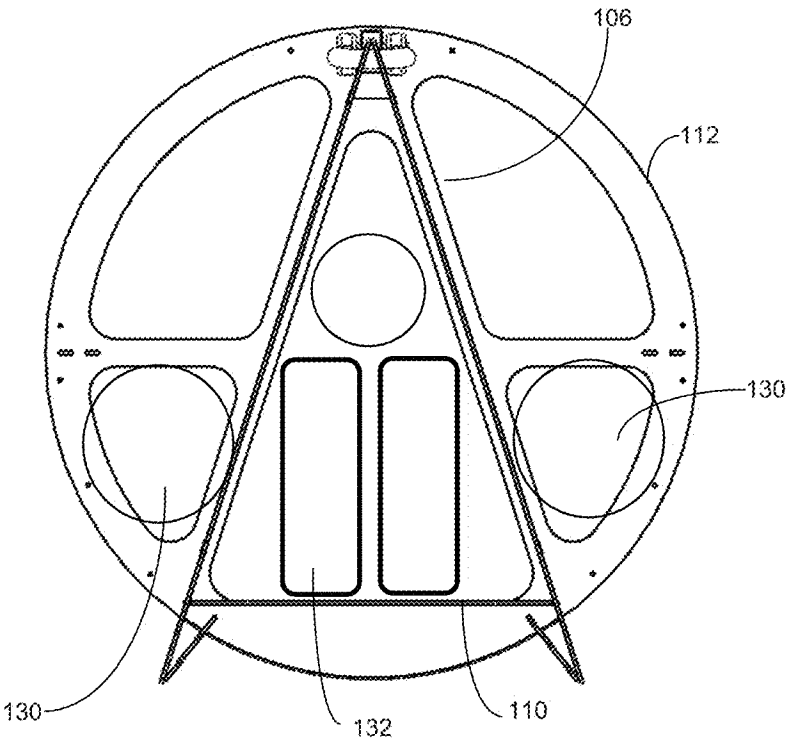
FIGS. 7 and 8 are front views of the loadbearing frame structure of FIG. 2 with different sample payloads installed therein.
Figure 7:
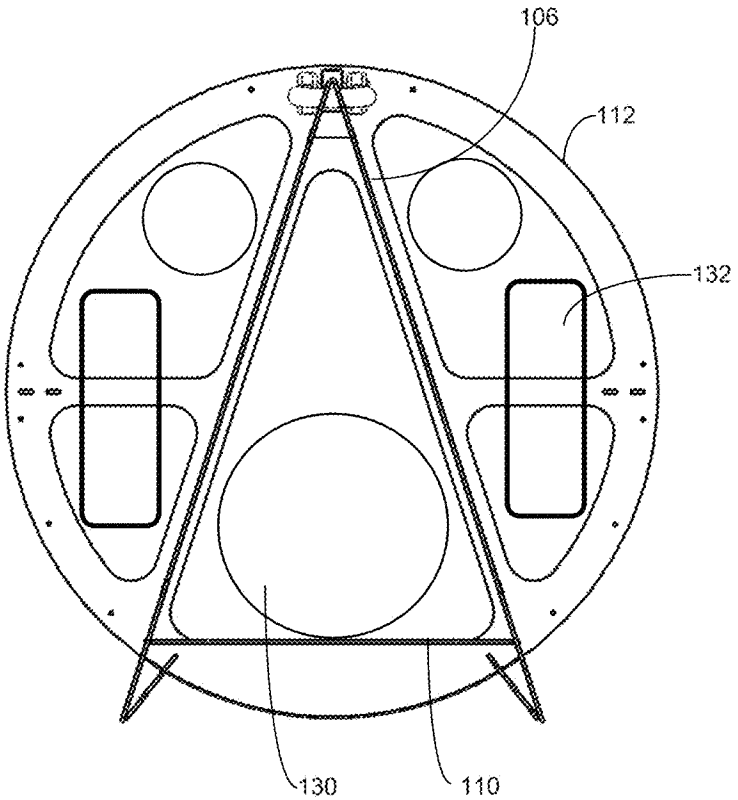

FIGS. 6-8 illustrate the frame structure 104 with installed payloads. FIG. 6 shows the frame structure 104 supporting a central battery 130 and payload 132 in a flanked payload configuration. FIG. 7 shows the extents of the payload bay 134, and another central battery 130, flanked by payloads 132. FIG. 8 shows a central payload 132, flanked by batteries 130.

Figure 10:
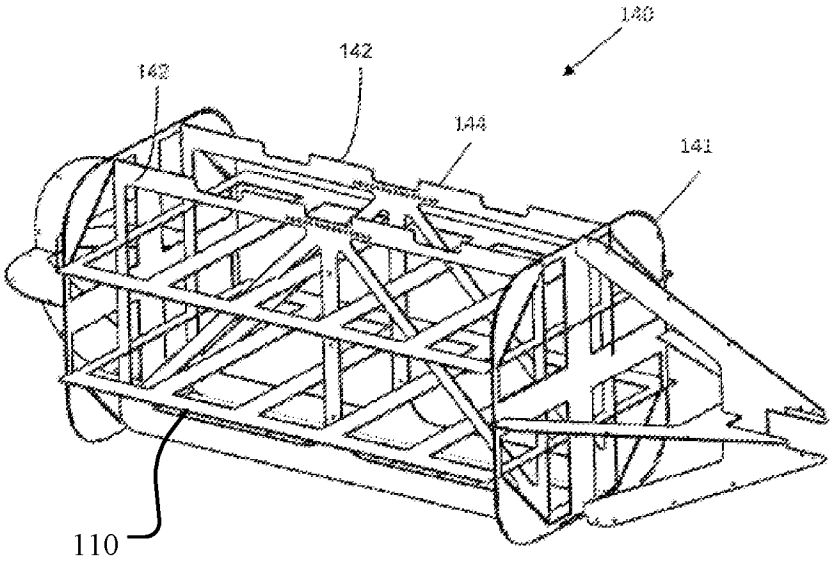
FIGS. 9 and 10 are front and perspective views, respectively, of an alternate double-beam lift frame structure in accordance with one or more embodiments.
Figure 9:
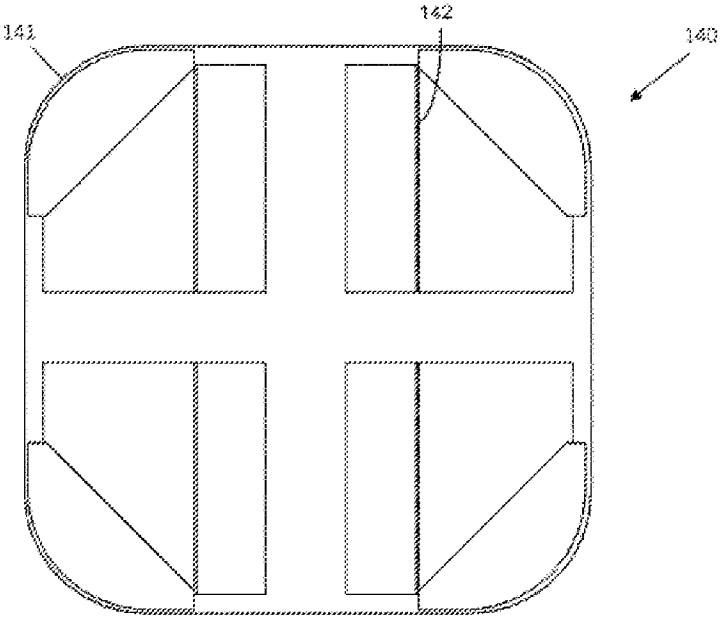
Figure 11:
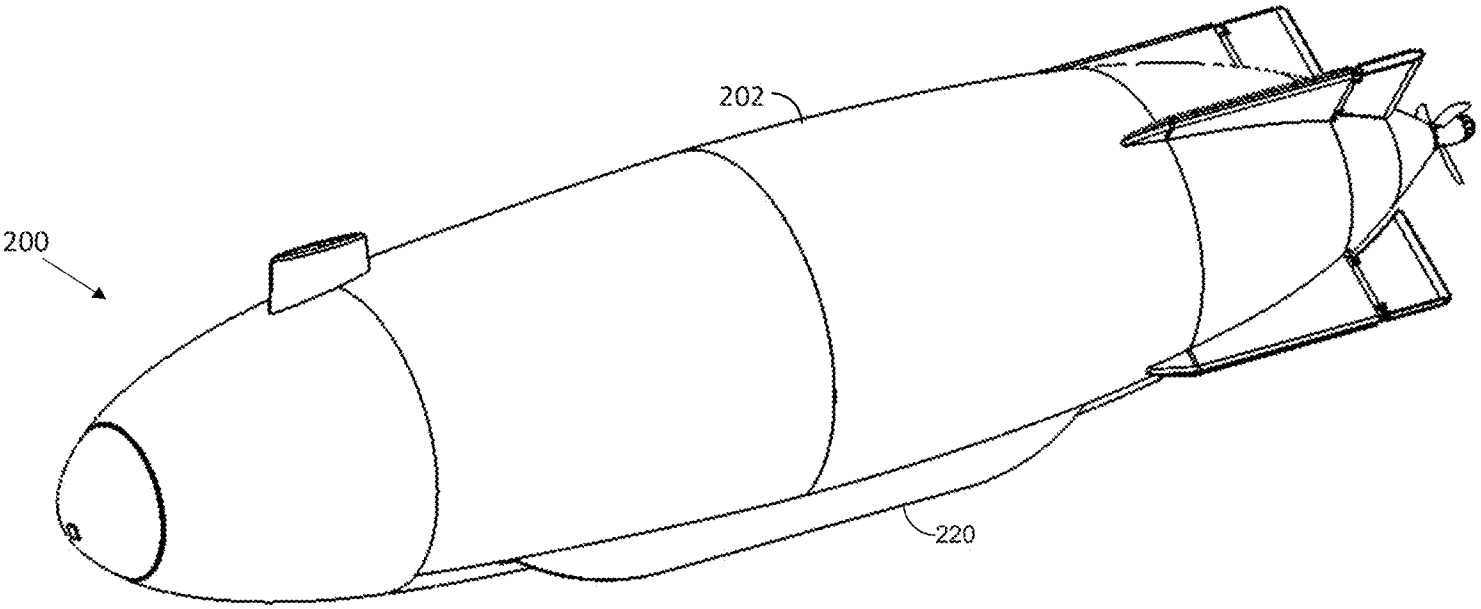
FIG. 11 is a perspective view of another exemplary maritime vehicle in accordance with one or more embodiments.
Figure 12:
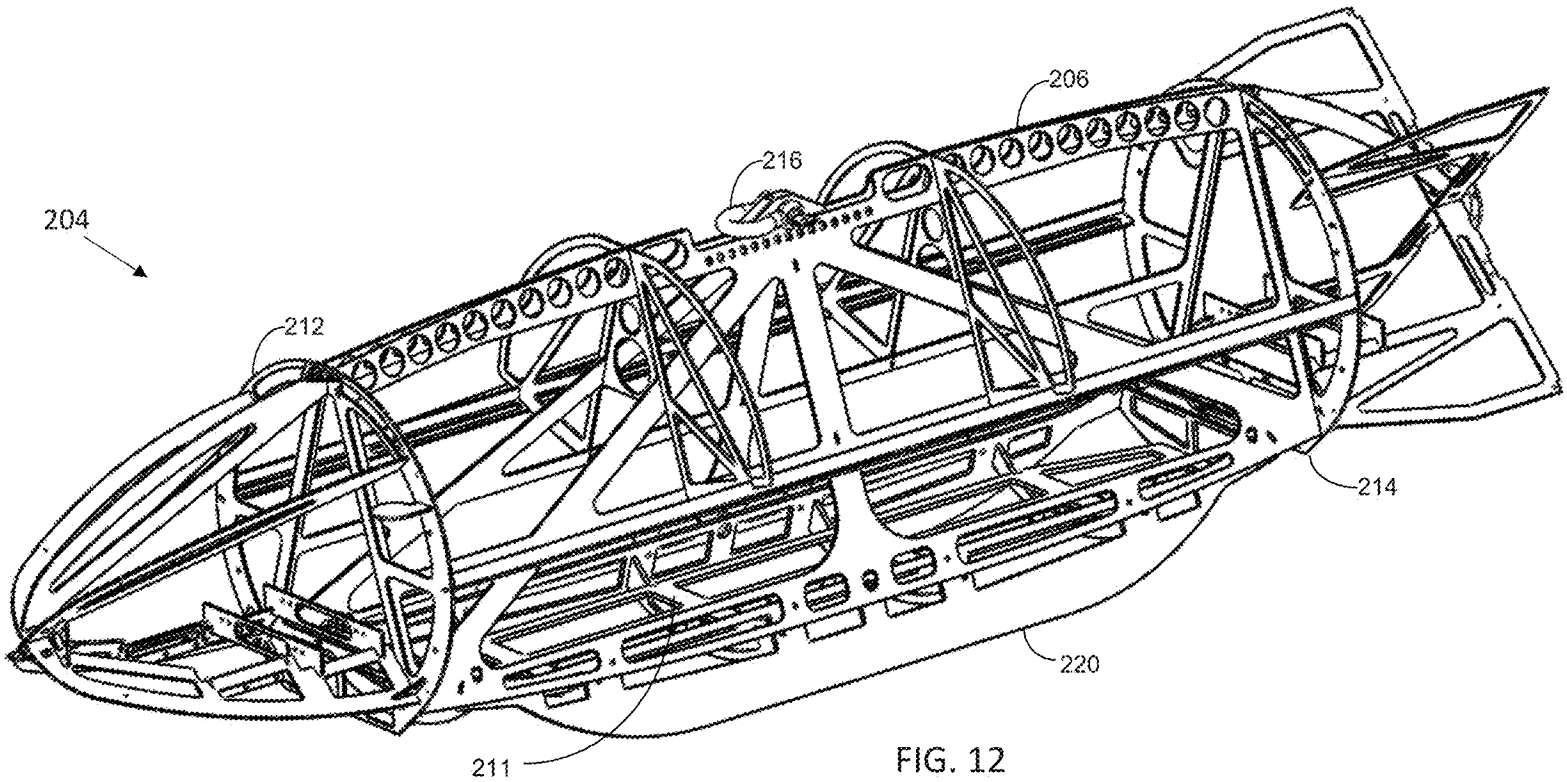
FIG. 12 is a perspective view of an exemplary load-bearing frame structure for the maritime vehicle of FIG. 11 in accordance with one or more embodiments.
Figure 13:
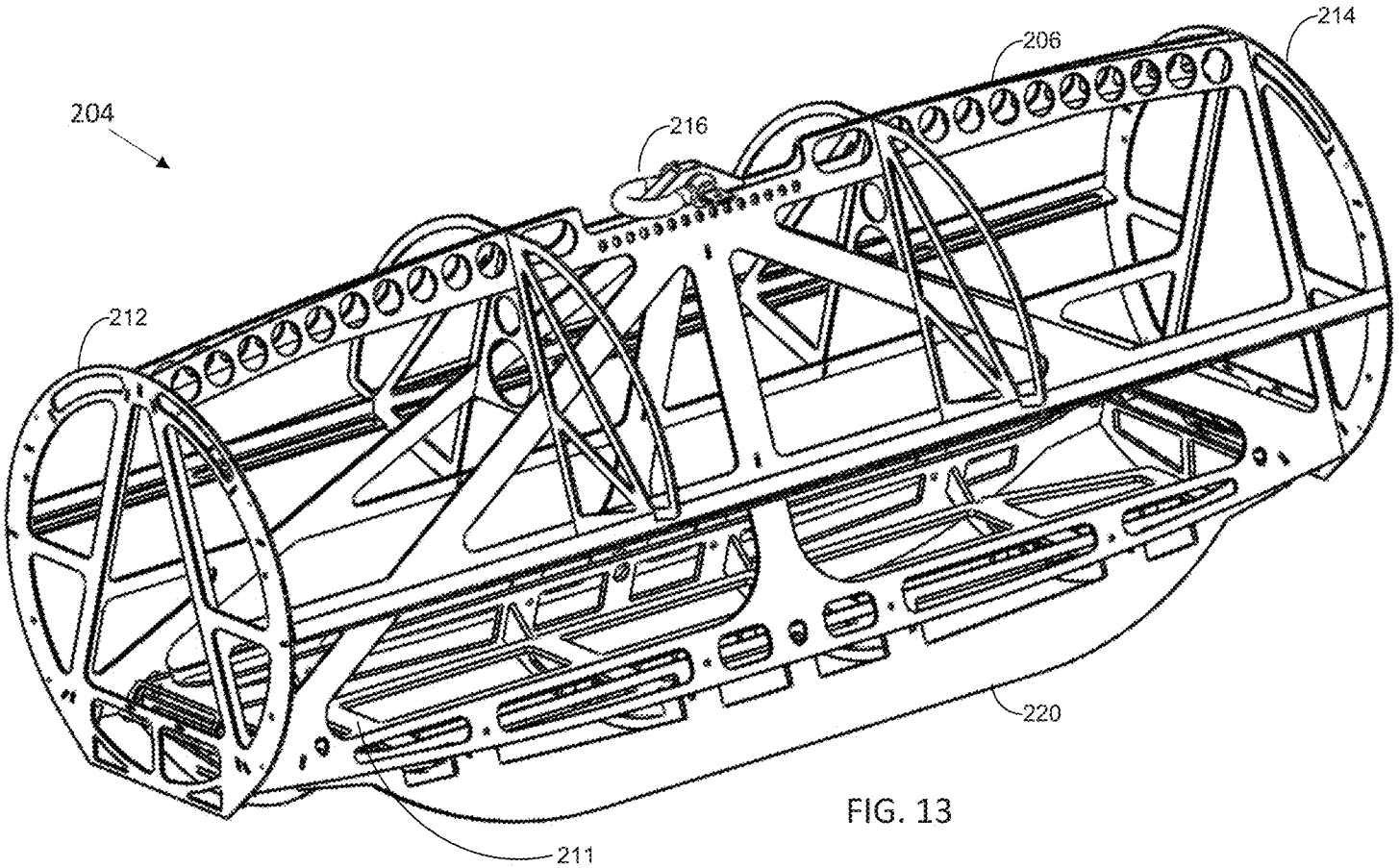
FIG. 13 is a perspective view of the center section of the loadbearing frame structure of FIG. 12.
Figure 14:
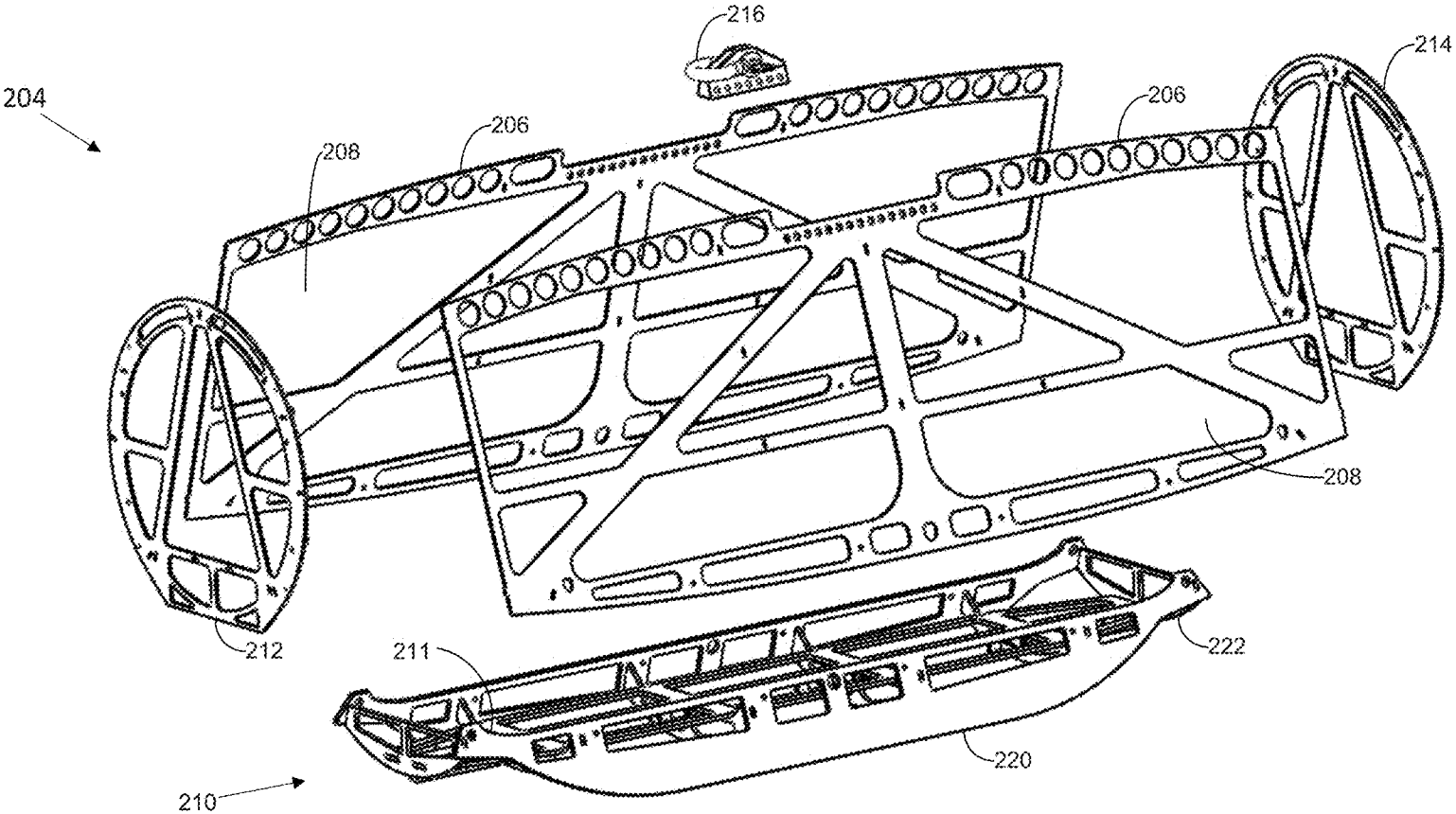
FIG. 14 is an exploded view of the center section of the loadbearing frame structure of FIG. 12.
Figure 15:
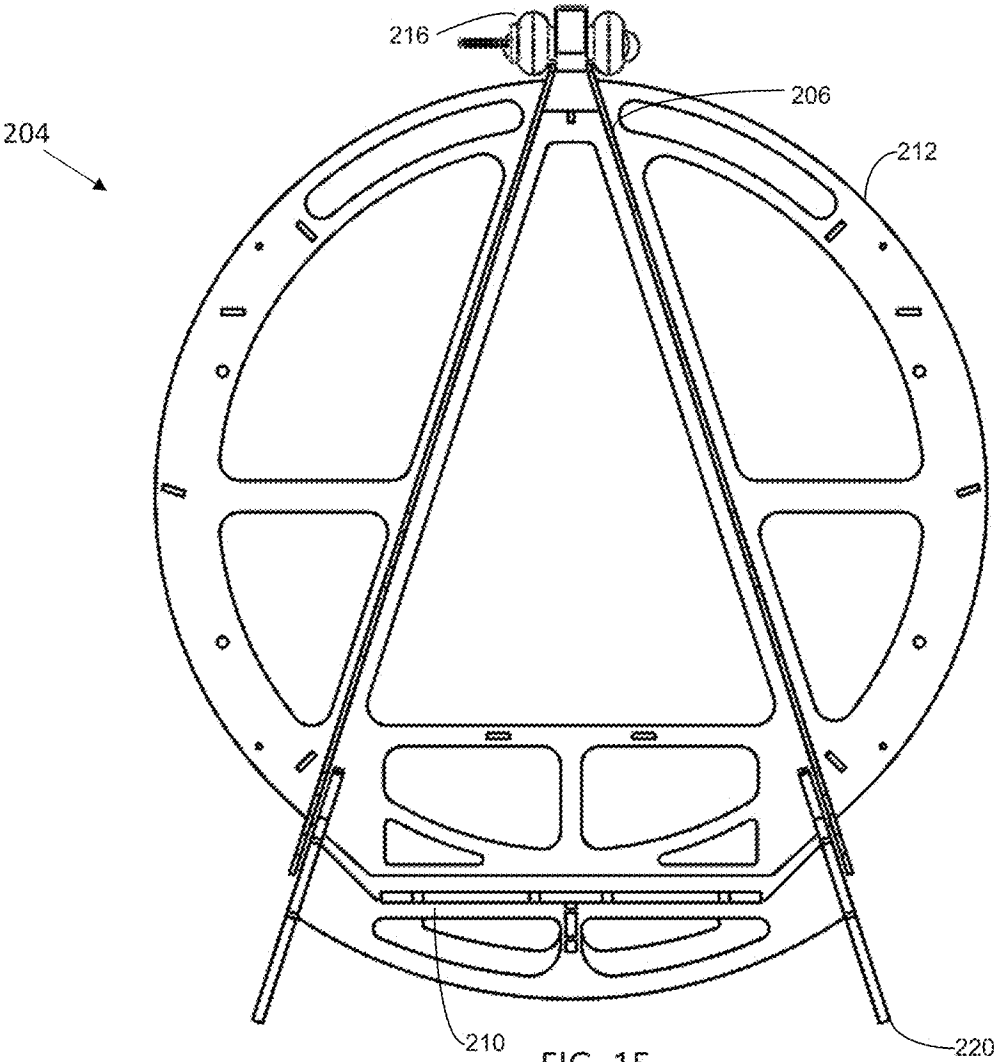
FIG. 15 is a front view of the center section of the loadbearing frame structure of FIG. 12.
Figure 16:
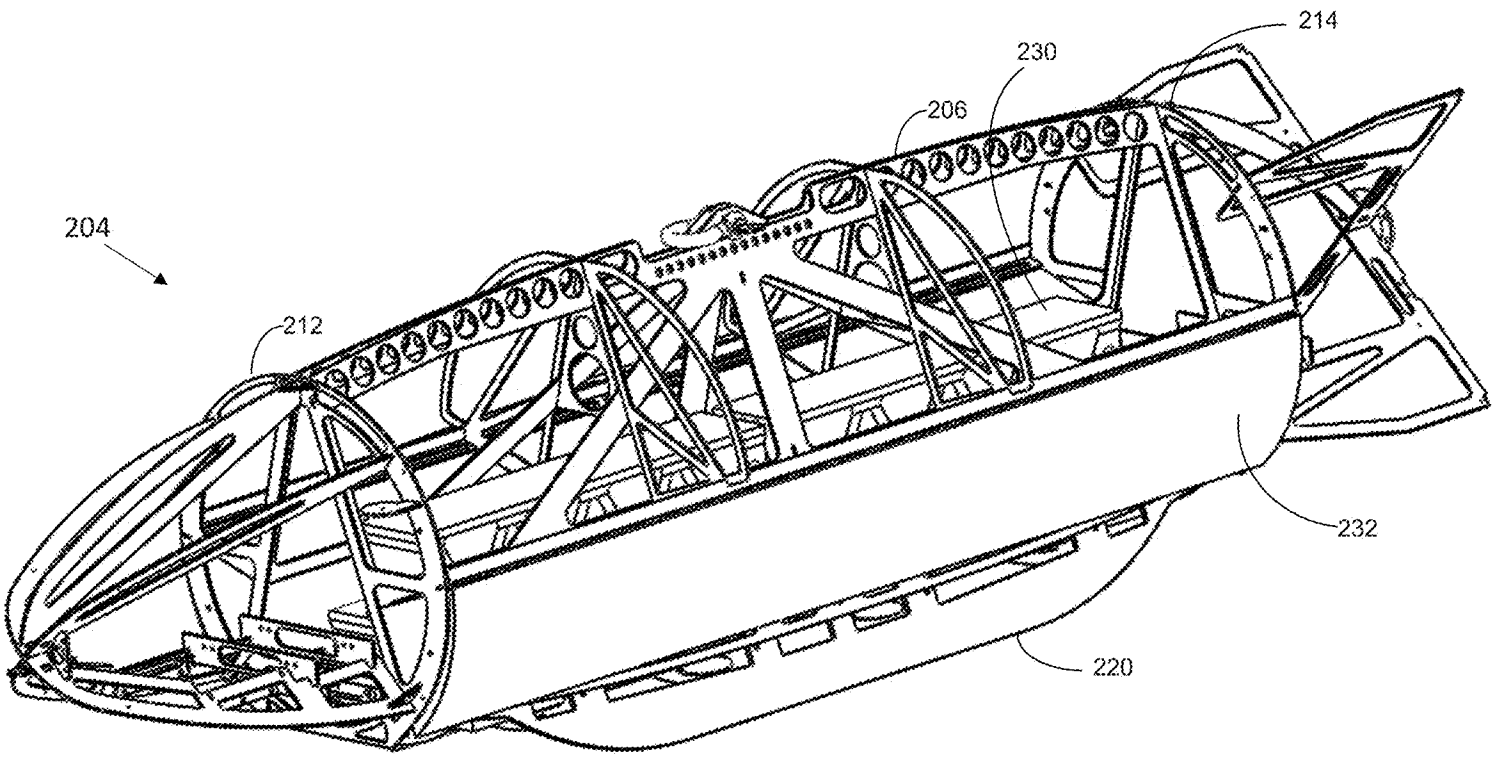
FIG. 16 is a perspective view of the loadbearing frame structure of FIG. 12 with a sample payload installed therein.

FIGS. 9 and 10 are front and perspective views, respectively, of an alternate double-beam lift frame structure 140 in accordance with one or more embodiments. The support plates 142 of structure 140 do not have an upside down V-shape configuration as in the previously described embodiments. The support plates 142 instead have a parallel vertical arrangement, with the deck plate 110 in a horizontal orientation connecting the support plates 142. In this embodiment, two lifting shackles (not shown) can be provided at the top of each plate 142 at 144.

FIGS. 11-19 illustrate another exemplary maritime vehicle 200 in accordance with one or more embodiments. The vehicle 200 includes a load-bearing frame structure 204 (shown in FIGS. 12-19) covered by an external fairing 202 (shown in FIG. 11) for streamlining the vehicle 200 to reduce drag.

The load-bearing frame structure 204 includes two angled support plates 206 whose top edges are connected to each other forming an inverted V-shape similar to the load-bearing frame structure 104 of the vehicle 100 depicted in FIGS. 1-8. In the illustrated exemplary embodiment, the two support plates 206 form an angle of about 36° to each other, though various other angles are also possible including, e.g., an angle between 10° to 60°.

The support plates 206 include sections 208 that have been cut-out to reduce weight, leaving the remaining portions of the plates to provide structural support. Various processes may be used to remove the cutout sections 208 from the support plates 206. Such processes can include, e.g., a waterjet cutting process or a laser cutting process. In one or more alternate embodiments, the two support plates 206 can be 3-D printed.

The frame structure 204 also includes a front bulkhead structure 212 connecting the front edges of the two support plates 206. It further includes a back bulkhead structure 214 connecting the back edges of the two support plates 206.

A deck plate structure 210 connects the two support plates 206 near the bottom edges of the support plates 206. The deck plate structure 210 includes a deck plate 211 and a set of bilge bulkheads 222 connected to the underside of the deck plate 211. The deck plate structure 210 also includes vehicle support skids 220, which are configured to support the vehicle 200 on a surface without additional support equipment.

In accordance with one or more embodiments, the deck plate 211 can be used to hold items such as equipment and payload.

Figure 19:
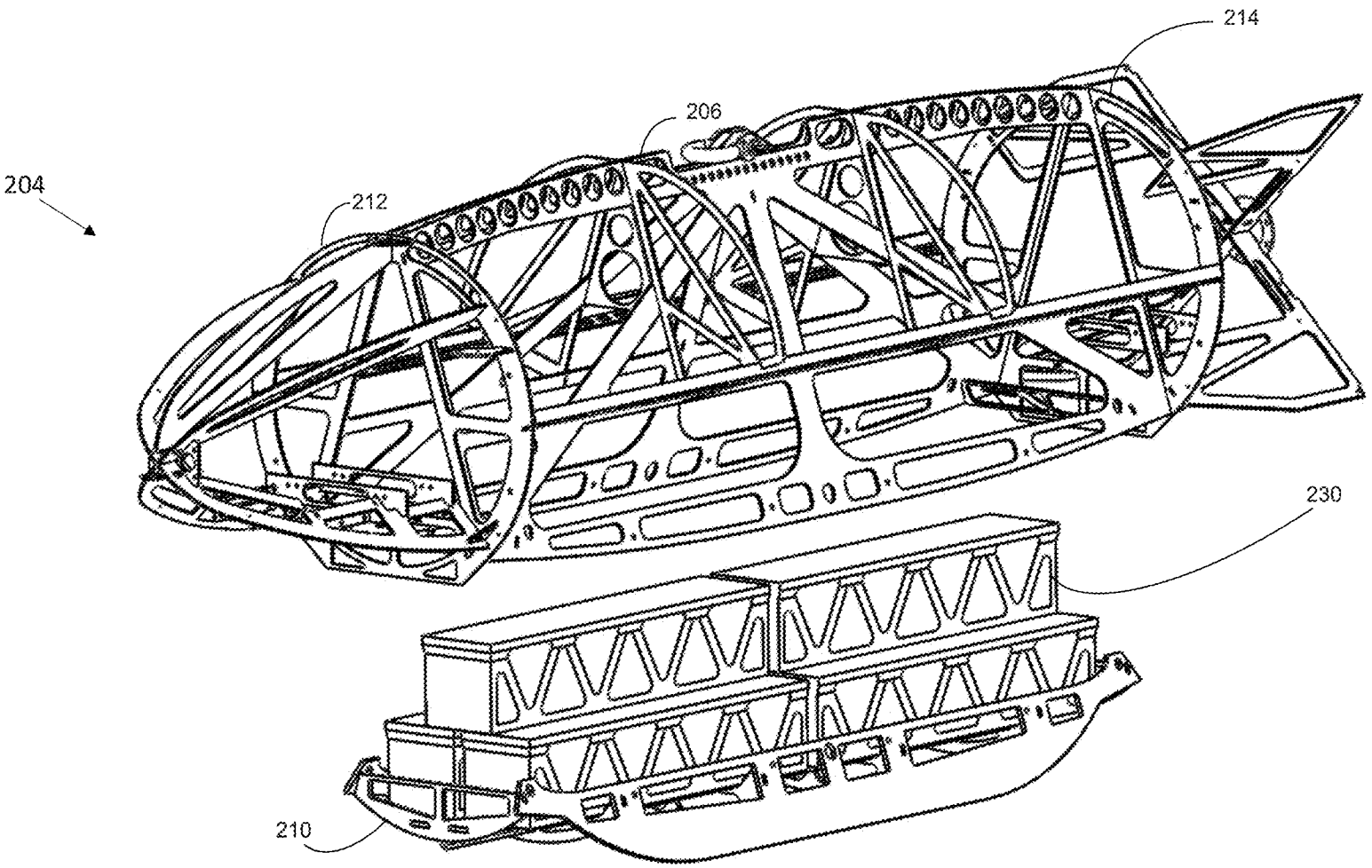
FIG. 19 is a perspective view of the loadbearing frame structure of FIG. 12 showing the deck plate separated from the rest of the frame structure to provide internal access.

In accordance with one or more embodiments, the deck plate structure 210 is removably connected to the rest of the frame structure 204. As illustrated in FIG. 19, the deck plate structure 210 can be separated from the rest of the frame structure 204 to permit easy access to equipment and payload on the deck plate 211 and elsewhere in the frame structure 204.

In accordance with one or more embodiments, the two support plates 206, the deck plate structure 210, the front bulkhead structure 212, and the back bulkhead structure 214 each comprise aluminum or aluminum alloys, stainless steel, titanium, or plastic. In one particular embodiment, the components are each constructed from 5083 aluminum alloy sheets.

In one particular embodiment, the components are each constructed from ¼ inch thick sheets. The thickness of the components can be varied depending on the size of the frame structure 204 and the desired loading capacity.

The two support plates 206, the front bulkhead structure 212, and the back bulkhead structure 214 are preferably welded together. The components can also be connected using other means, including using nuts and bolts and other fasteners.

The deck plate structure 210 is removably connected to the rest of the frame structure 204 using fasteners such as nuts and bolts and various other suitable fastening systems. An exemplary fastening mechanism can include a set of rods passed through the two support plates 206 and the deck plate structure 210 to couple the deck plate 210 and the frame 204 together when installed.

The frame structure 204 also includes a center lifting shackle 216 connected to the top edges of the two support plates 206. The center lifting shackle 216 can be used in lifting the entire maritime vehicle 200 from a single point. In one or more alternate embodiments, particularly for longer vehicles, two or more lifting shackles that are spaced apart along the length of the vehicle 200 can be used for lifting the vehicle 200.

In one or more embodiments, the upper portion of the frame structure 204 can be lifted away from the deck plate structure 210 after the structures have been uncoupled as depicted in FIG. 19 to provide easy access to items stored on the deck plate structure 210 and in the frame structure 204.

The outer edges of the front bulkhead structure 212 and the back bulkhead structure 214 can be generally circular and are configured to support the vehicle fairing. Other shapes are also possible.

The front bulkhead structure 212 and the back bulkhead structure 214 have generally flat bottoms for supporting the frame structure 204 on a surface in a stable manner when the deck plate structure 210 is removed from the rest of the frame structure 204.

Figure 18:
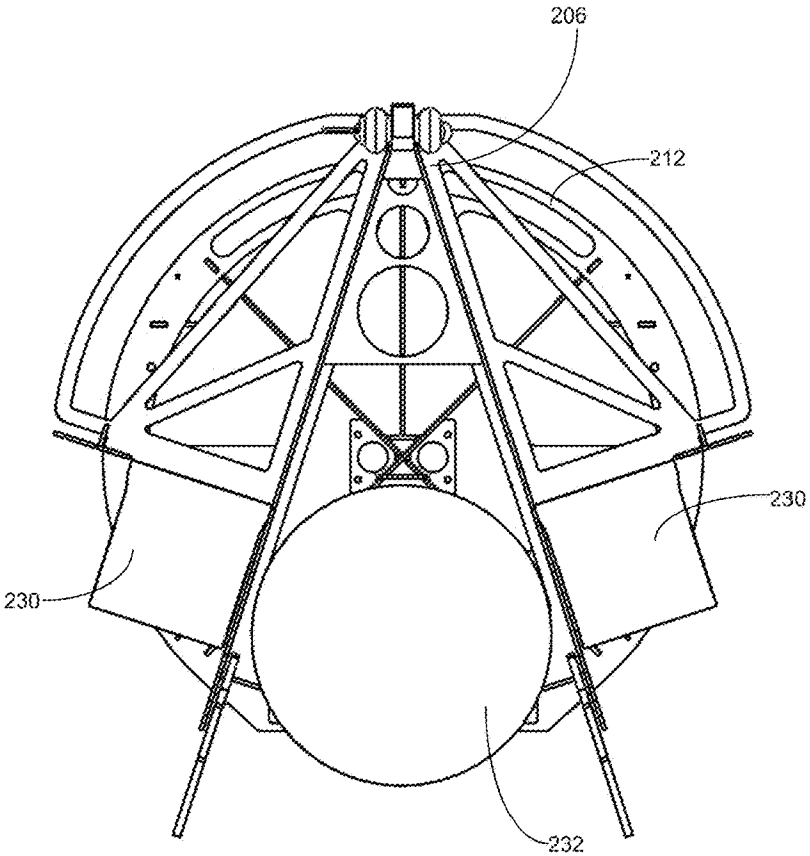
FIGS. 17 and 18 are front views of the loadbearing frame structure of FIG. 12 with different sample payloads installed therein.
Figure 17:
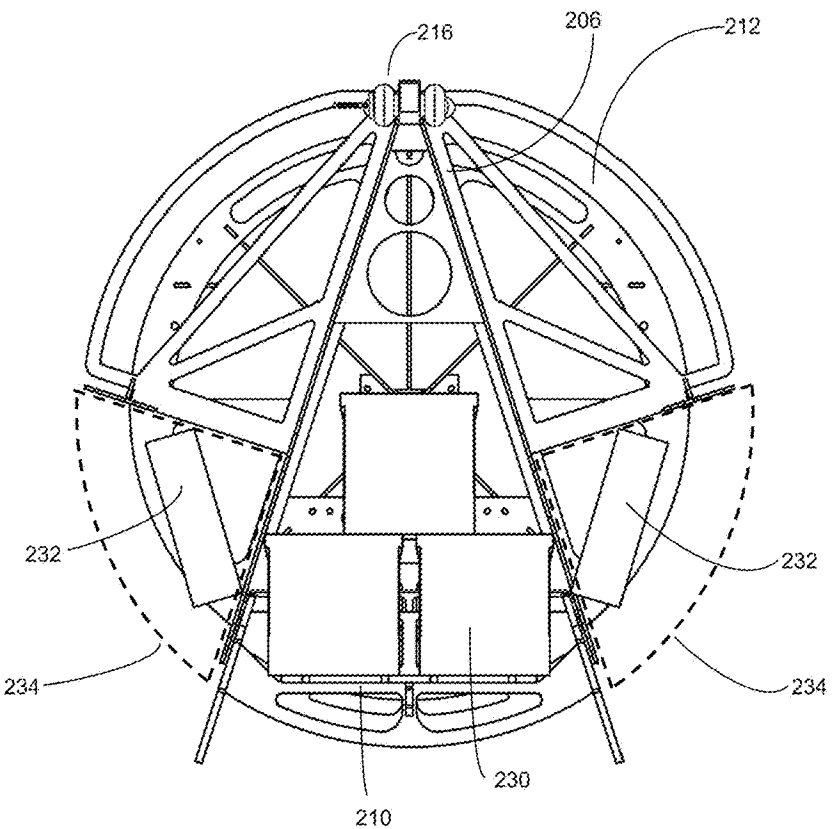

FIGS. 17-19 illustrate the frame structure 204 with installed payloads and equipment. FIG. 17 shows the frame structure 204 supporting batteries 230 and payload 232 in a flanked payload configuration. FIG. 17 also shows the extents of the payload bay 234. FIG. 18 shows a central payload 232, flanked by batteries 230.

The frame structures disclosed herein offer numerous advantages over the prior art. The frame structures in accordance with one or more embodiments locate load-bearing components of the structures near the center of the vehicle. Therefore, batteries and payloads supported by such load-bearing components are protected and less susceptible to damage. In addition, the deck plate of the structures enables large and/or heavy payloads to be easily and securely held in the vehicle.

The frame structures allow for the integration of long (e.g., 3*m* in some embodiments) payload arrays on the port and starboard sides of vehicle that are not obstructed by vehicle structure members.

Batteries and other items can be mounted to deck plate or the support plates of the structures depending on payload configuration. Batteries and other items can also be located on removable deck plate trays for ease of access as applicable.

In addition, the frame structures can be inexpensively constructed from sheets of aluminum or other materials, which can be easily and precisely constructed by processes such as waterjet cutting. The components can be connected by welding in some embodiments (without use of nuts and bolts).

The frame structures can be used in a variety of maritime vehicles including, e.g., autonomous, semi-autonomous, and human-controlled maritime vehicles. The maritime vehicles can reside on the surface or underwater during use. In one particular case, the vehicles are autonomous underwater vehicles.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments.

Additionally, elements and components described herein may be further divided into additional components or joined together to form fewer components for performing the same functions.

Accordingly, the foregoing description and attached drawings are by way of example only, and are not intended to be limiting.

The invention claimed is:

1. A load-bearing frame structure for a maritime vehicle, comprising:

two support plates, each having a front edge, a back edge, a top edge, and a bottom edge, the two support plates being angled relative to each other and connected to each other at the top edges thereof forming an inverted V-shape, each of the two support plates having one or more cut-out sections;

a deck plate structure connecting the two support plates proximate the bottom edges of the two support plates;

a front bulkhead structure connecting the front edges of the two support plates; and a back bulkhead structure connecting the back edges of the two support plates.

2. The load-bearing frame structure of claim 1, wherein the maritime vehicle is an autonomous maritime vehicle.

3. The load-bearing frame structure of claim 1, wherein the maritime vehicle is an underwater maritime vehicle.

4. The load-bearing frame structure of claim 1, wherein the maritime vehicle is an autonomous underwater vehicle.

5. The load-bearing frame structure of claim 1, wherein the deck plate structure is removably connected to the two support plates.

6. The load-bearing frame structure of claim 1, wherein the maritime vehicle can be lifted off the deck plate structure to provide access to equipment or payload held in the maritime vehicle.

7. The load-bearing frame structure of claim 1, further comprising:

vehicle support skids configured to support the maritime vehicle on a surface.

8. The load-bearing frame structure of claim 1, wherein the maritime vehicle support skids are configured to support the maritime vehicle on a surface without use of additional support equipment.

9. The load-bearing frame structure of claim 1, wherein the two support plates, the deck plate structure, the front bulkhead structure, and the back bulkhead structure are each constructed from at least one of aluminum, stainless steel, titanium, composite, or plastic.

10. The load-bearing frame structure of claim 1, wherein the two support plates, the deck plate structure, the front bulkhead structure, and the back bulkhead structure are each constructed from one or more aluminum alloy sheets.

11. The load-bearing frame structure of claim 1, wherein the cutout sections of each of the two support plates are formed by a waterjet cutting process.

12. The load-hearing frame structure of claim 1, wherein the two support plates, the deck plate structure, the front bulkhead structure, and the back bulkhead structure are each constructed by at least one of waterjet cutting, laser cutting, or 3-D printing.

13. The load-bearing frame structure of claim 1, wherein the two support plates, the deck plate structure, the front bulkhead structure, and the back bulkhead structure are welded together.

14. The load-bearing frame structure of claim 1, wherein the two support plates, the deck plate structure, the front bulkhead structure, and the back bulkhead structure are fastened together.

15. The load-bearing frame structure of claim 1, wherein the deck plate structure is removable.

16. The load-bearing frame structure of claim 1, wherein the maritime vehicle is an autonomous underwater vehicle, the deck plate structure being removably connected to the autonomous underwater vehicle.

17. The load-bearing frame structure of claim 1, further comprising:

one or more lifting shackles connected to the top edges of the two support plates for use in lifting the maritime vehicle.

18. The load-bearing frame structure of claim 1, wherein outer edges of the front bulkhead structure and the back bulkhead structure are configured to support a vehicle fairing.

19. The load-bearing frame structure of claim 1, wherein the front bulkhead structure and the back bulkhead structure are configured for supporting the two support plates on a surface when the deck plate structure is removed.

20. The load-bearing frame structure of claim 1, wherein the two support plates form an angle of between 10° to 60° relative to each other.

21. The load-bearing frame structure of claim 1, wherein the two support plates are configured to support equipment or payloads between the two support plates and a vehicle fairing.

22. The load-bearing frame structure of claim 1, wherein the deck plate structure is configured to support equipment or a payload.

23. A load-bearing frame structure for an autonomous underwater vehicle, comprising:

two support plates, each having a front edge, a back edge, a top edge, and a bottom edge, the two support plates being parallel to each other in a vertical orientation, each of the two support plates having one or more cut-out sections;

a deck plate structure in a horizontal orientation connecting the two support plates, a front bulkhead structure connecting the front edges of the two support plates; and a bark bulkhead structure connecting the back edges of the two support plates.

24. The load-bearing frame structure of claim 23, wherein the deck plate structure is removably connected to the two support plates.

25. The load-bearing frame structure of claim 23, further comprising:

vehicle support skids configured to support the autonomous underwater vehicle on a surface.

26. The load-bearing frame structure of claim 23, wherein the two support plates, the deck plate structure, the front bulkhead structure, and the back bulkhead structure are each constructed from at least one of aluminum, stainless steel, titanium, composite, or plastic.

27. The load-hearing frame structure of claim 23, wherein the two support plates, the deck plate structure, the front bulkhead structure, and the back bulkhead structure are welded or fastened together.

28. The load-bearing frame structure of claim 23, wherein the deck plate structure is removably connected to one or more of the two support plates, the front bulkhead structure, and the back bulkhead structure.

29. The load-bearing frame structure of claim 23, further comprising:

one or more lifting shackles connected to the top edges of the two support plates for use in lifting the autonomous underwater vehicle.

30. The load-baring frame structure of claim 23, wherein outer edges of the front bulkhead structure and the back bulkhead structure are configured to support a vehicle fairing.

31. The load-bearing frame structure of claim 23, wherein the front bulkhead structure and the back bulkhead structure are configured for supporting the frame structure on a surface when the deck plate structure is removed.

32. The load-bearing frame structure of claim 23, wherein the two support plates are configured to support equipment or payloads between the two support plates and a vehicle fairing.

33. The load-bearing frame structure of claim 23, wherein the deck plate structure is configured to support equipment or a payload.

* * * * *